US005147509A

United States Patent [19]

Kuragasaki et al.

[11] Patent Number: 5,147,509

[45] Date of Patent: Sep. 15, 1992

[54] HEADBOX FOR A PAPERMAKING MACHINE WITH DISTRIBUTION TUBES

[75] Inventors: Mutsuo Kuragasaki; Yasuhiro Sueoka, both of Nagasaki; Akira Equchi; Tetsuo Makino, both of Hiroshima, all of Japan

[73] Assignee: Beloit Corporation, Beloit, Wis.

[21] Appl. No.: 543,881

[22] Filed: Jun. 25, 1990

[51] Int. Cl.[5] ..... D21F 1/02

[52] U.S. Cl. ..... 162/343; 162/336

[58] Field of Search ..... 162/336, 343, 344, 216

[56] References Cited

U.S. PATENT DOCUMENTS

| | | | |
|---|---|---|---|
| 2,894,581 | 7/1959 | Goumeniouk | 162/343 |
| 3,098,787 | 7/1963 | Sieber | 162/343 |
| 3,309,264 | 3/1967 | Parker et al. | 162/343 |
| 3,316,144 | 4/1967 | Knowles | 162/343 |
| 3,351,522 | 11/1967 | Lopas | 162/343 |
| 3,573,160 | 3/1971 | Lopas | 162/216 |
| 3,725,197 | 4/1973 | Dahl et al. | 162/216 |

*Primary Examiner*—Karen M. Hastings

*Attorney, Agent, or Firm*—Dirk J. Veneman; Raymond W. Campbell; David J. Archer

[57] ABSTRACT

A headbox apparatus is disclosed for ejecting stock onto a forming wire of a papermaking machine. The apparatus includes a header for the flow therethrough of the stock. The header finds an inlet and an outlet, the outlet having an upstream and a downstream end. The header is tapered in a cross-machine direction from the upstream end towards the downstream end such that the flow of stock through the outlet remains substantially constant from the upstream to the downstream end. A distributor is disposed immediately downstream relative to the outlet and in fluid communication therewith. The distributor includes a plurality of distributor tubes which are disposed parallel relative to each other. Each of the tubes has an upstream extremity such that the stock flows from the outlet through each of the upstream extremities. Each of the extremities defines an upstream edge and a downstream edge such that for each tube, the upstream edge is nearer than the downstream edge to the upstream end of the outlet. The upstream edges only of the tubes are rounded such that the generation of eddies within the tubes is inhibited.

1 Claim, 4 Drawing Sheets

HEADBOX FOR A PAPERMAKING MACHINE WITH DISTRIBUTION TUBES

BACKGROUND OF THE INVENTION

Field of the Invention

The present invention relates to a headbox apparatus for ejecting stock onto a forming wire of a papermaking machine.

SUMMARY OF THE INVENTION

Applicants have discovered that by rounding only the upstream edges of each of the headbox distributor tubes, the generation of eddies within the tubes is inhibited.

DETAILED DESCRIPTION OF THE INVENTION

This invention relates to a headbox apparatus applied to a paper machine.

Figure 3:
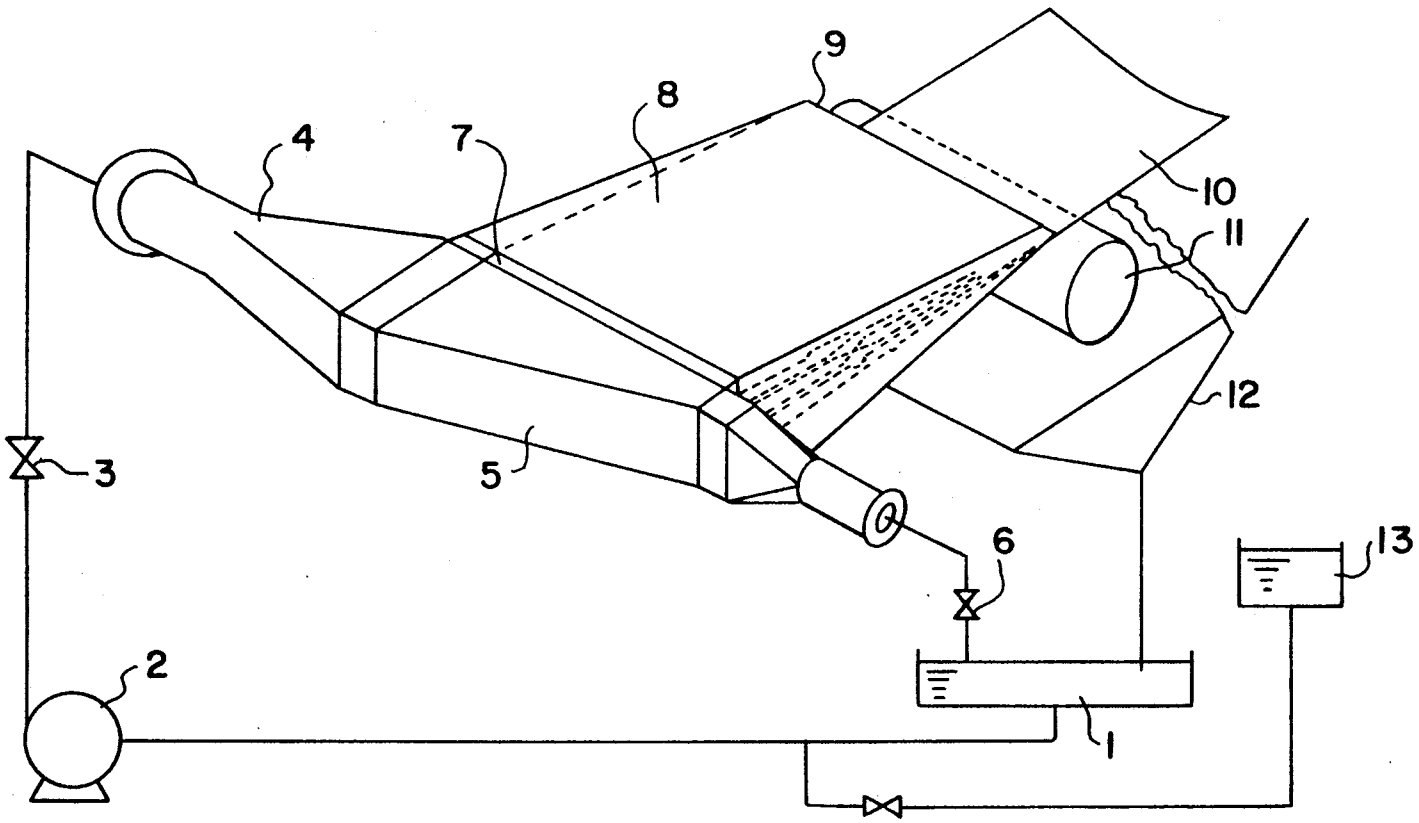
FIG. 3 PRIOR ART
FIG. 3 is a perspective view of a prior art headbox arrangement.
Figure 4:
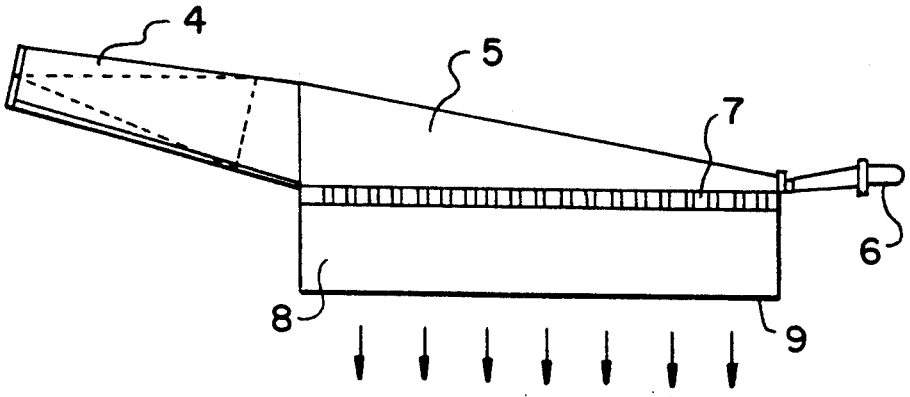
FIG. 4 PRIOR ART
FIG. 4 is a top plan view partially in section of a prior art headbox apparatus.

FIG. 3 is a prior art arrangement and shows a piping layout of conduits for a general paper machine and FIG. 4 shows a top plan view partially in section of the prior art headbox as shown in FIG. 3. In the drawings, water from the pulp or stock in a tank 1 is pressurized by a pump 2. Fluid flow is controlled by a valve 3 and stock is supplied to a taper header 5 via inlet pipe 4. About 90% of the stock is transversely distributed by a distributor 7 and ejected over a wire 10 driven by a roll 11 through a dispenser 8 and a lip 9. Water removed through the wire 10 is returned to a tank 1 via return pipe 12. Pipeline containing high consistency stock is connected to the pipeline and is controlled to maintain constant density.

Water from the pulp ejected onto the wire as described above and which stays on the wire 10, is dewatered by a press in a secondary process (not shown) and is taken up by a reel (not shown) after being dried by a dryer. Unless the stock is evenly sprayed transversely over the wire 10 in the production process, uneven basis weight of the paper will be produced and degradation of the paper will result.

Figure 5:
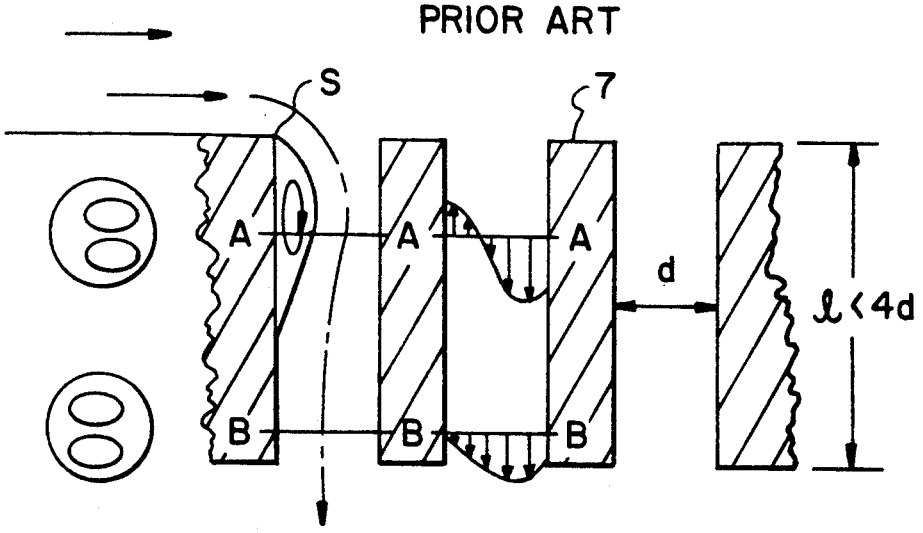
FIG. 5 PRIOR ART
FIG. 5 is an enlarged view of the upstream extremities of the prior art distributor tubes in which the edges thereof are not rounded, thereby generating eddies within the tubes.

Problems have been experienced in the flow of the stock ejected onto the wire 10 via lip 9 as described above. The flow from the tapered header 5 into the distributor 7, at the edge *7c* of inlet side end of the opening on the upstream side forms a rectangular corner as seen in FIG. 5. Such peels off at a point S on the upstream side of the inlet end of the opening as shown in FIG. 5. This inclines toward the downstream end at a section A—A as indicated by a flow line b. The velocity distribution grows high at the downstream end as indicated by a symbol c. Reversed flow area occurs on the upstream side. A pair of split symmetric swirls or eddies are produced in the central area of the opening in a direction downstream from upstream and as indicated by a symbol a, until it reaches the outlet of the opening (section B—B). The flow direction at the central portion is directed to flow is biased toward the downstream of the machine after it flows into the dispenser 8. As a result, the flow velocity at the inlet side when ejected over the wire 10 via lip 9 becomes lower than that of opposite recirculation side. Such has caused a deviation in basis weight and paper quality in a transverse direction.

The present invention offers a solution to overcome the above described problems.

In order to overcome the problems, the present invention provides a rounded edge for the inlet side end of the opening on the side of the upstream end for all the openings or at least some of the tubes in the distributor of the tapered header for the headbox of a paper machine.

By providing a rounded edge from the inlet side end of the opening on the side of the upstream end, a smooth flow of the fluid into the opening can be obtained without peeling. Such flow is accomplished with a less biased velocity distribution and the magnitude of the swirl component is substantially reduced. As a consequence, the direction of flow at the outlet opening runs almost parallel to the axis of the opening and any biased flow can dispensing portion.

Figure 1:
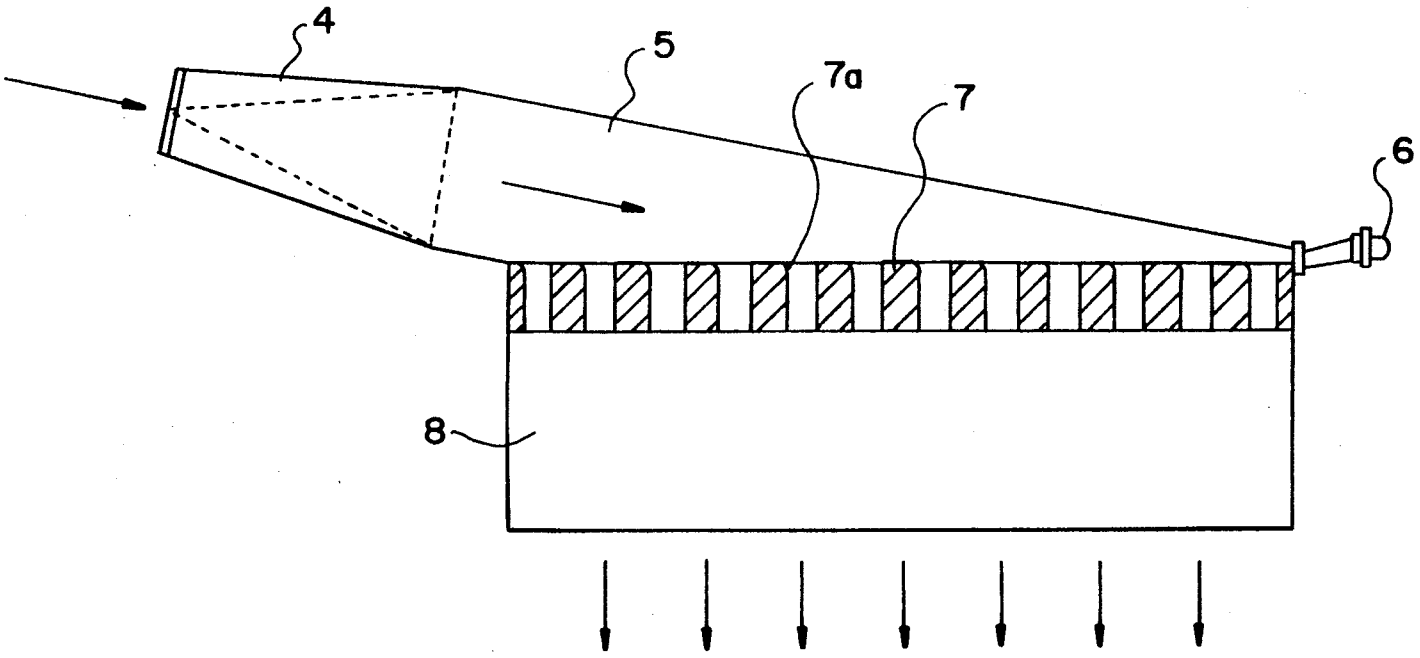
FIG. 1 is a top plan view partially in section of the headbox apparatus according to the present invention.
Figure 2A:
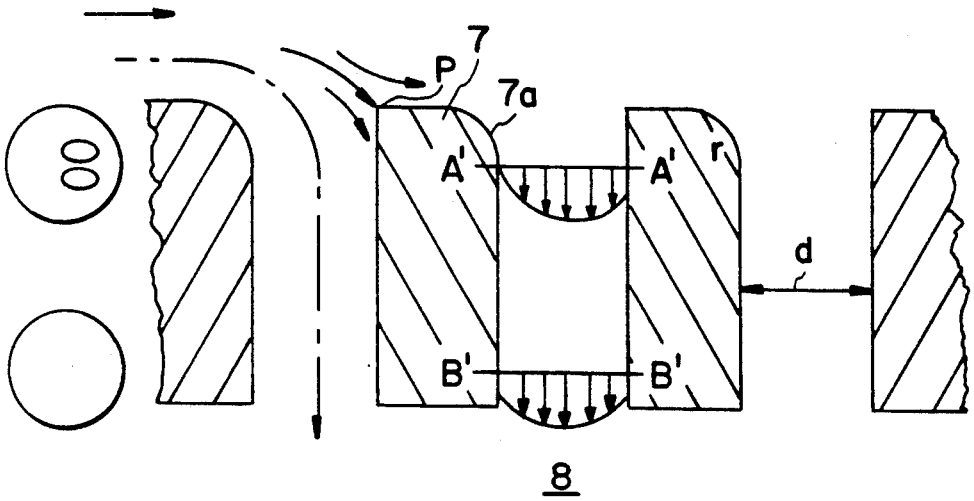
FIG. 2A is an enlarged view of the upstream extremity of some of the distributor tubes of the headbox shown in FIG. 1.
Figure 2B:
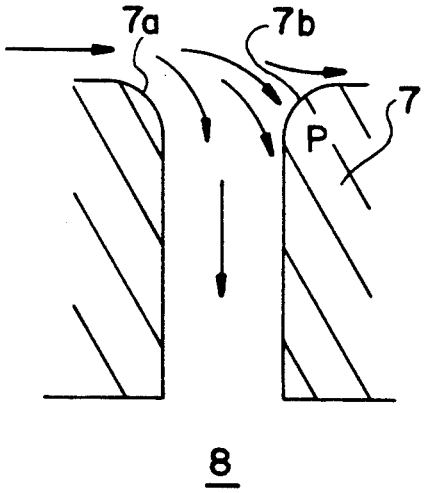
FIG. 2B is a similar view to that shown in FIG. 2A but shows a tube in which the upstream extremity is rounded on both the upstream and downstream edge.

A description will be made with reference to the drawings. FIGS. 1 and 2 show one embodiment of the invention in which 4 is an inlet pipe, 5 is the tapered header, 6 is a valve and 7 is a distributor. As seen in FIG. 1, the edge *7a* of the inlet side end of the opening on the upstream side of the distributor 7 adjacent to the tapered header 5 is rounded. The roundness should not be fixed but should be changeable depending on the fluid velocity within the taper header 5 and the opening. Normally, the dimension of the roundness is sufficient to take the value of $r/d > 0.5$ relative to the diameter d of the opening (wherein r is a radius of roundness at the edge *7a* on the upstream side). In view of the fact that fluid resistance from the header 5 is reduced at the branch point by providing roundness, uniform velocity distribution may be effected by rounding only on the opening where lowered fluid velocity takes place to increase the flow rate in that area and by regulating the flow distribution in addition to the controlled direction of flow. While stagnant flow indicated by the point P in FIG. 2(*b*) centers at a single point P' in the absence of roundness on the downstream side indicated in FIG. 2(*a*), if the edge *7b* is also rounded as seen in FIG. 2(*b*) on the downstream side of the opening of the distributor 7, such rounded edge will effect a change in flow by a slight external disturbance, thereby resulting in an unstable amount of flow into the opening. This will cause an unwanted change in distribution of the flow into the dispenser 8 from the distributor 7, and therefore, it is necessary to provide roundness only on the edge *7a* of the opening.

In operation of the present invention, the fluid shears off at the point S on the upstream side of the end of the opening, which has been experienced in the prior practice as seen in FIG. 5. Such tends to smoothly flow into the opening without any separation by providing roundness on the edge 7*a* of inlet end of opening on the upstream side. As a result, biased velocity distribution is made uniform and the magnitude of the swirl component is substantially reduced as seen in section A'—A' of FIG. 2(*a*). Accordingly, the velocity distribution and slight residual of the swirling component are brought into a uniform flow resulting from the friction against the wall surface and the viscosity while flowing through a short path inside the opening. Also, the direction of flow coincides almost with the axis of the opening. Therefore, biased flow can be prevented by leading the jet flow to the dispenser 8. In addition, the section B'—B' in FIG. 2(*a*) corresponds to the position of section B—B in FIG. 5.

By providing roundness on the edge of the inlet end of the opening on the upstream side, the direction of flow at the distributor outlet almost coincides with the direction of the axis of the opening. Biased flow in a traverse direction at the dispersing portion is prevented and fluid velocity from the lip portion of stock ejected onto the wire in the transverse direction is made uniform. Thus, the quality of paper can be improved without causing uneven basis weight of the paper in the transverse direction.

We claim:

1. A headbox apparatus for ejecting stock onto a forming wire of a papermaking machine, said apparatus comprising:

a header for the flow therethrough of the stock, said header defining an inlet and an outlet, said outlet having an upstream and a downstream end, said header being tapered in a cross-machine direction from said upstream end towards said downstream end such that said flow of stock through said outlet remains substantially constant from said upstream to said downstream end;

a distributor disposed immediately downstream relative to said outlet and in fluid communication therewith, said distributor including:

a plurality of distributor tubes, each tube of said plurality of tubes being disposed parallel relative to each other, each of said tubes having an upstream extremity such that the stock flows from said outlet through each of said upstream extremities, each of said extremities defining an upstream edge and a downstream edge, the arrangement being such that for each tube, said upstream edge is disposed nearer than said downstream edge to said upstream end of said outlet; and said upstream edges only of said tubes being rounded such that the generation of eddies within said tubes is inhibited.

* * * * *

UNITED STATES PATENT AND TRADEMARK OFFICE

CERTIFICATE OF CORRECTION

PATENT NO. : 5,147,509

DATED : September 15, 1992

INVENTOR(S) : Kuragasaki, et al

It is certified that error appears in the above-indentified patent and that said Letters Patent is hereby corrected as shown below:

| | |
|---|---|
| Column 2, Line 9: | After "directed to", please insert --the downstream as indicated by a symbol b, and the entire--. |
| Column 2, Line 32: | After "flow can", please insert --be prevented by allowing the jet flow to lead to the--. |

Signed and Sealed this

Fourteenth Day of September, 1993

Bruce Lehman

*Attest:*

BRUCE LEHMAN

*Attesting Officer*

*Commissioner of Patents and Trademarks*